US005401532A

United States Patent [19]

Coughlan

[11] Patent Number: 5,401,532

[45] Date of Patent: Mar. 28, 1995

[54] MANUFACTURE OF SIMULATED LEAD LIGHTS

[76] Inventor: Thomas N. Coughlan, Ashleaf House, Iona Road, Montenotte, Cork, Ireland

[21] Appl. No.: 22,022

[22] Filed: Feb. 25, 1993

Related U.S. Application Data

[63] Continuation-in-part of Ser. No. 656,493, Feb. 19, 1991, abandoned.

[30] Foreign Application Priority Data

Feb. 16, 1990 [IE] Ireland ..... 578/90
Mar. 22, 1990 [IE] Ireland ..... 1059/90

[51] Int. Cl.[6] ..... B05D 1/00

[52] U.S. Cl. ..... 427/203; 427/199; 427/205; 427/383.5; 427/383.7

[58] Field of Search ..... 427/203, 199, 205, 383.5, 427/383.7

[56] References Cited

U.S. PATENT DOCUMENTS 3,653,946 4/1972 Fefferman ..... 427/383.5
3,900,641 8/1975 Woodman ..... 156/277
3,931,425 1/1976 Kuroda ..... 156/581
3,967,265 6/1976 Jacob ..... 359/296
4,103,052 7/1978 Summers et al. ..... 428/38

FOREIGN PATENT DOCUMENTS 0038681 9/1984 European Pat. Off. .
2165800 4/1986 United Kingdom .
86/02599 5/1986 WIPO .

OTHER PUBLICATIONS

G. G. Hawley "The Condensed Chemical Dictionary" Van Nostrand Reinhold Company, 1971, p. 171.

*Primary Examiner*—Shrive Beck
*Assistant Examiner*—Vi Duong Dang
*Attorney, Agent, or Firm*—Pollock, Vande Sande & Priddy

[57] ABSTRACT

A method of manufacturing a simulated lead light in which simulated opaque lead canes are built up on a surface of a carrier, comprising the following steps:

(1) applying lines of an opaque paint to the carrier surface, the lines corresponding to desired positions of the desired lead canes;
(2) while the paint is still wet, applying transparent or translucent particulate material so that the particulate material adheres to the wet paint;
(3) removing surplus unadhered particulate material.

8 Claims, No Drawings

MANUFACTURE OF SIMULATED LEAD LIGHTS

RELATED APPLICATIONS

This is a continuation-in-part of application Ser. No. 07/656,493, filed on Feb. 19, 1991, now abandoned.

FIELD OF THE INVENTION

The present invention primarily concerns a method of manufacturing simulated lead lights and stained glass windows of the kind, for example, disclosed in European Patent Specification No. 0 038 681.

Brief Description of the Preferred Embodiments

The present invention provides a method of manufacturing a simulated lead light in which simulated opaque lead canes are built up on the surface of a transparent or translucent carrier. The method comprises the following steps:

(1) applying lines of an opaque paint to the carrier surface, the lines corresponding to the positions of the desired lead canes;

(2) while the paint is still wet, applying transparent or translucent particulate material so that it adheres to the wet paint;

(3) removing surplus unadhered material; and (4) drying the paint and the adhered particulate material;

By repeating the above steps, the method allows for the build up, in a sandwich-like manner, of one or more layers comprising opaque paint and transparent or translucent particulate material. It is a preferred feature that in applying subsequent layers, a finer grade of particulate material is applied so as to optimally fill any voids on the surface of the coating, which voids are due to the previously applied coarse sized particles.

Inclusion of transparent or translucent particulate material permits ease of production of many colored versions, in particular, white, pale grey and other pastel color versions of simulated lead lights. This is because the opaque paint, which is applied to the carrier surface and applied on successive sandwich layers comprising paint and particulate material, may be any color paint including pastels. Since the particles are transparent or translucent, they may be easily obliterated by the paint, including pastel colored paint, whereas it would be difficult to achieve obliteration using pastel colors if dark colored particles were used. If using dark colored particles, it is very difficult to cover over particles with one coat of paint especially if that paint is of a light pastel color. Thus, the use of large size transparent or translucent particles, such as in the range 120–180 grit size provide a means of readily building up thick sandwich layers whereas, otherwise, many layers of paint only, would be required. The use of large sized particles also confers good intercoat adhesion of layers and also confers high overall cohesive strength of both individual and combined layers. In other words, using large particles confers good strength within each individual layer and also combined layers against cracking and dimensional changes due to temperature fluctuations during use.

Thus, use of transparent or translucent particulate material has the effect that the particulate material does not cause obliteration problems when being overcoated with paint. This is because the transparent or translucent particulate material is obviously easily overcoated with any color paint, including pastels, without any underlying particle color showing through the paint coating. Hence the transparent or translucent particles are much more easily obliterated than opaque particulate material such as black silicon carbide particles, for instance. Thus the use of transparent or translucent particulate material facilitates the easy achievement of any colored version of the finished product since easier overcoating of the underlying substrate is possible using any color paint, including pastels. A further advantage of the use of transparent or translucent particulate material is that it is more readily and cheaply available.

The method according to the invention includes a final application of opaque paint prior to final drying and curing procedure.

In an alternative embodiment for use in applications where such high durability is not required, the present invention further provides a method of manufacturing a simulated lead light in which simulated opaque lead canes are built up on the surface of a transparent or translucent carrier. The method comprises applying lines of an opaque paint to the carrier surface. The lines correspond to the positions of the desired lead canes. A number of applications of opaque paint may be employed in order to achieve a desired thickness the minimum thickness typically being approximately 200 microns (dry film thickness).

The opaque paint may be based on, for example, two-pack Epoxy resin and preferably includes micaceous iron oxide (MIO) pigment or tinted versions thereof. The preferred MIO-based epoxy paint gives enhanced durability, opacity and resistance to chemicals and ultra violet radiation.

The opaque paint may include in its composition, at least one metallic pigment and/or other opacifying material such as aluminium, for example, in powdered form, copper, zinc, stainless steel, lead or chromium. The inclusion of aluminium, for instance, provides a tinting color. Furthermore, the addition of aluminium in the MIO-containing opaque paint results in enhanced durability.

Therefore, different tinted color versions of the preferred MIO Epoxy coating may be employed, while retaining the aesthetic and durability benefits of the high MIO pigment content of the paint. White or pastel color versions may also be produced by the method according to the invention. The opaque paint may be any color.

The opaque paint may be any color. In an alternative embodiment, gold leaf or simulated gold leaf may be applied over the final layer of opaque paint so as to enhance the decorative effect in addition to providing increased weathering durability.

If gold leaf or simulated gold leaf is applied over the final layer of opaque paint, it will cover all or some of the color of the underlying opaque paint layers. The application of gold leaf is an alternative embodiment of the invention which produces a particularly pleasing aesthetic effect. Furthermore, the gold leaf finish gives extra durability against ultraviolet and chemical attack and also gives extra commercial value to the finished product. Thus, the application of gold leaf renders the product particularly resistant to general weathering conditions including chemical attack and acid-rain. The gold leaf is applied while the final coal of paint is still "tacky," in other words, not wet. It is purchased in very thin sheets and can be applied as a "transfer" system. Such transfer technique for applying golf leaf is known in the art in other applications, such as church mouldings.

In other embodiments, other metallic finish effects may be obtained by using a final layer of opaque epoxy coating containing one or more metallic pigment such as aluminium, copper, zinc, lead, chromium, steel or stainless steel pigments. In applications where such metallic finish effects are desirable, the concentration of MIO may be reduced or indeed MIO can be omitted to achieve the desired effect if a lesser level of long-hem high durability is acceptable.

The above methods may include the use of natural and/or forced drying or curing techniques partially or wholly ho dry the paint and particulate material when applied.

The invention will now be described in more detail with reference to the following specific examples:

Example 1

(1) Lines of an opaque paint, preferably based on micaceous-iron oxide (MIO) pigment dispersed into two-pack epoxy media are applied to the surface of the transparent, translucent or opaque carrier by screen printing so as to form the desired pattern of simulated lead light canes, such as Tudor design or other design;

(2) dry transparent or translucent inorganic or organic particulate material, such as for example crushed glass or washed sea sand or plastic particles of similar particle size (e.g. in the range 120–180 grit size), is applied by dusting onto the screen-printed lines, and adheres to, the wet paint;

(3) unadhered particulate material is removed by brushing or compressed air-hose blowing, for example;

(4) the paint and the particulate material adhered thereto are allowed to dry. If desired, the drying process can be speeded up by force drying methods such as stoving. However, but in that case, only partial curing is effected. To achieve optimum intercoat adhesion, the curing or hardening time will vary depending on the temperature used and the composition of the epoxy resin used. Typically, the temperature will be in the range of 70° C. to 100° C.

(5) Step (1), above, is repeated to overcoat the partially constructed canes, thus providing an overall sandwich effect, the thickness of the overcoat being adjusted as required;

(6) while the paint is still wet, a finer grade, for example, in the range 320–600 grit size, of particulate material is applied in order to fill voids between the particles applied in step (2) and to enhance the durability of the coating and achieve a smoother appearance more like actual lead canes.

7) step (3 ) is repeated;

(8) Step (4) is repeated;

(9) Step (5) is repeated:

(10) The canes are then fully dried, preferably using a hard cure method such as stoving, in order to achieve the desired toughness parameters.

A typical durable simulated lead cane thickness may be built up by the above method to about 1.5 to 3 mm dry film thickness. Accelerated weathering tests showed that full adhesion and coating integrity were retained after testing for over 3000 hours. The test conditions are equivalent to exposure to approximately six years normal weathering.

EXAMPLE 2

A typical formulation of an opaque color coating is as follows:

All w/w ratios are given with respect to the weight of the coating.

| | |
|---|---|
| Micaceous iron oxide | 30–40% w/w |
| Metallic Powders (e.g. leafing aluminium paste). | 2–4% w/w |
| Organic or inorganic pigments e.g. $Tio_2$ or Phthalocyanoblue | 5–10% w/w |
| Two-pack epoxy resin | 25–35% w/w |
| Solvents, for example, glycol ethers higher alcohols or/and aromatic hydrocarbons. | 25–30% w/w |
| Additives | 4–5% w/w |

The preferred micaceous iron oxide (MIO) epoxy paint may also contain circa 2% to 4% of leafing aluminium paste.

Activator for Epoxy resin

The MIO epoxy paint may be reached and cured with activators such as polyamide or suitable polyamine types or adducts as desired to suit production curing schedules. Such technology and curing methods are known in the art.

EXAMPLE 3

Example of white version of the opaque paint

| | |
|---|---|
| Rutile Titanium dioxide pigment | Circa 30% w/w |
| Two-pack Epoxy Resin | 25–35% wlw |
| Additives | 4–5% w/w |

The formulations given in examples 2 and 3 contain various additives including surfactants, diapersants and theology control additives such as hydrogenated castor oil, aluminium stearate or Bentonire gellants.

The method allows for various drying or force drying procedures on plastic sheets, for instance, which may not be able to endure high temperatures.

The method according to the invention allows the use of relatively inexpensive, readily available materials such as the transparent or translucent particulate material and also provides benefits in durability and resistance to U.V. light by the preferred embodiment of including high levels of MIO in the opaque paint coatings.

The opaque paint is preferably based on a two-pack epoxy resin which includes micaceous iron oxide pigment together with at least one metallic pigment or opacifying material such as aluminium, for example.

Though the invention is described above with reference to the manufacture of simulated lead lights, it will be understood that designs other than traditional Tudor type "lead lights" may also be constructed using the method outlined above. Such other designs may be constructed on glass sheets and other plastic sheeting or opaque sheet material such as decorative panels. Furthermore, suitable "light-fast" and translucent colored coatings based on two-pack epoxy resins or polyurethane resins may be applied to surface areas of the carrier within the outline simulated lead cane design i.e.

stain-glass window effect. These coatings may be applied by screen-printing during the manufacture of the simulated lead lights in accordance with the present invention, so as to ensure good alignment. Alternatively the colored coatings may be applied by spray or other application methods and using stencils or similar arrangement such as masking-over areas not to be stained so as to color all or certain design panels only, in order to achieve the desired aesthetic effect. Such methods of simulating stained glass appearance are know in the art.

I claim:

1. A method of manufacturing a simulated lead light in which simulated opaque lead canes are built up on a surface of a transparent or translucent carrier, comprising the following steps:

(1) applying lines of an opaque paint to the carrier surface, the lines corresponding to desired positions of the desired lead canes;

(2) while the paint is still wet, applying transparent or translucent particulate material so that the particulate material adheres to the wet paint;

(3) removing surplus unadhered particulate material.

2. A method according to claim 1, further comprising repeating the steps of applying lines of paint and applying particulate material, wherein the particulate material initially applied has a course grit size and layers of particulate material subsequently applied have a finer grit size.

3. A method according to claim 1, further comprising the steps of applying a final line of opaque paint and drying and curing the paint and adhered material.

4. A method according to claim 1, wherein the opaque paint is based on a two-pack epoxy resin.

5. A method according to claim 1, wherein the opaque paint includes micaceous-iron oxide pigment or tinted versions thereof.

6. A method according to claim 1, wherein the opaque paint includes in its composition, at least one metallic pigment selected from the group consisting of: aluminium, copper, zinc, stainless steel, lead and chromium.

7. A method according to claim 1, wherein gold leaf, or simulated gold leaf, is applied over the final layer of opaque paint.

8. A method according to claim 2, further comprising the steps of applying a final line of opaque paint and drying and curing the paint and adhered material.

* * * * *